US005876098A

United States Patent [19]

Conaway et al.

[11] Patent Number: 5,876,098

[45] Date of Patent: Mar. 2, 1999

[54] HI-CHI MEDITATION CHAIR

[76] Inventors: Katherine A. Conaway; Raymond E. Conaway, both of R.R. 1 Box 61A, So. Londonderry, Vt. 05155

[21] Appl. No.: 90,202

[22] Filed: Jun. 1, 1998

[51] Int. Cl.[6] ..... A47C 1/00

[52] U.S. Cl. ..... 297/446.1; 297/449.1; 297/354.11; 297/284.9

[58] Field of Search ..... 297/446.1, 440.15, 297/446.2, 447.3, 448.1, 449.1, 450.1, 451.12, 440.13, 440.23, 354.11, 284.9, 284.11

[56] References Cited

U.S. PATENT DOCUMENTS

| | | | |
|---|---|---|---|
| 1,182,670 | 5/1916 | Fountain | 297/440.23 X |
| 1,762,622 | 6/1930 | Gray | 297/450.1 |
| 2,554,490 | 5/1951 | Eames | 297/449.1 X |
| 2,776,700 | 1/1957 | Potter et al. | 297/440.13 X |
| 2,823,737 | 2/1958 | Eriksen | 297/450.1 X |
| 3,087,758 | 4/1963 | Deaton | 297/440.23 X |
| 3,565,486 | 2/1971 | Channon | 297/440.1 X |
| 3,568,225 | 3/1971 | Radke | 297/284.9 X |
| 3,575,465 | 4/1971 | Dolby et al. | 297/440.15 X |
| 3,604,749 | 9/1971 | Parmett | 297/451.12 X |
| 3,620,570 | 11/1971 | Wilson et al. | 297/451.12 |
| 3,663,059 | 5/1972 | Omlie | 297/440.23 X |
| 3,799,611 | 3/1974 | Steinfeld | 297/440.23 |
| 4,593,950 | 6/1986 | Infanti | 297/440.13 X |
| 4,603,903 | 8/1986 | Moscovitch | 297/440.1 X |
| 5,372,405 | 12/1994 | Cash et al. | 297/440.13 X |
| 5,636,900 | 6/1997 | Wilkie et al. | 297/284.9 X |
| 5,813,722 | 9/1998 | Smith | 297/451.12 X |

FOREIGN PATENT DOCUMENTS

| | | | |
|---|---|---|---|
| 1429378 | 1/1969 | Germany | 297/446.1 |
| 935479 | 8/1963 | United Kingdom | 297/440.1 |
| 1173209 | 12/1969 | United Kingdom | 297/284.9 |

*Primary Examiner*—Peter M. Cuomo
*Assistant Examiner*—David E. Allred

[57] ABSTRACT

A specially designed chair that sits low to the floor having a trapezoidal seat (14), two sides (10) so shaped as to accommodate two knee supports (12) and a pivotal backrest (16) and a cushion (24) for the primary purpose of meditation in a lotus style position with full support while in a relaxed state.

4 Claims, 2 Drawing Sheets

HI-CHI MEDITATION CHAIR

BACKGROUND

1. Field of Invention

This invention relates to the primary purpose of meditation, more specifically to a chair that offers full body support while sitting in the lotus style position.

2. Description of Prior Art

With today's lifestyle, stress is an everyday condition with more and more doctors and medical reports tying stress to illness—physical and mental. Meditation is gaining wide acceptance in the West in dealing with this stress.

For thousands of years the spiritual masters of the East and others who meditate have used the sitting lotus position for the maximum flow of CHI (energy) through the body while meditating. One of the prime conditions in all forms of meditation is the need for total relaxation while maintaining an attentively fixed position in order to obtain the maximum benefits of meditation.

Often those who practiced meditation started at a very early age when that position was easily attained and continued throughout their lifetime with little or no discomfort.

With the movement toward meditation and relaxation practice more and more people of all ages are becoming interested and involved in such practices. Many of these people must sit in a chair because they cannot attain the desired lotus position, or if they do, they are so uncomfortable that they cannot completely relax for the full benefit of meditating, even some lifelong meditators have succumbed to using pillows of various shapes in order to relieve some of the stress on the hip and knee areas.

Through extensive patent searching I have not found any such chair per se, or other rigid holding device for meditating in the lotus style position. Trade magazines offer pillows, cushions, baskets and benches, but none offer full body support for a totally relaxed lotus position.

A cushion or pillow to sit on will raise one a few inches off the floor, and at best, slightly relieve the stress these people are trying to eliminate, but they offer no back or knee support and if sitting forward enough to draw the feet in close, the knees have no support which puts a strain on the hip and knee joints and causes discomfort in a very short time.

OBJECTS AND ADVANTAGES

Accordingly, several objects and advantages of this invention over prior art are:

(a) A chair that is fully supportive of the body while in the lotus style position so as to relieve stress in the knees, thighs, hips and lower back.

(b) A chair that allows people an opportunity to attain the lotus style position that would normally have a difficult if not impossible time assuming such a position.

(c) A chair low to the floor that is a beneficial position when meditating.

(d) A chair with a trapezoidal shaped seat with sides that naturally lends support to the thighs and knees when in a lotus style position.

(e) A chair with a low curved back that supports the lower back area and helps the user maintain a good meditative posture while minimzing back muscle tension.

(f) A chair with knee supports that contributes to the users ability to remain comfortable for a longer period of time while meditating.

DRAWING FIGURES

DESCRIPTION—FIGS. 1 to 4

Figure 2:
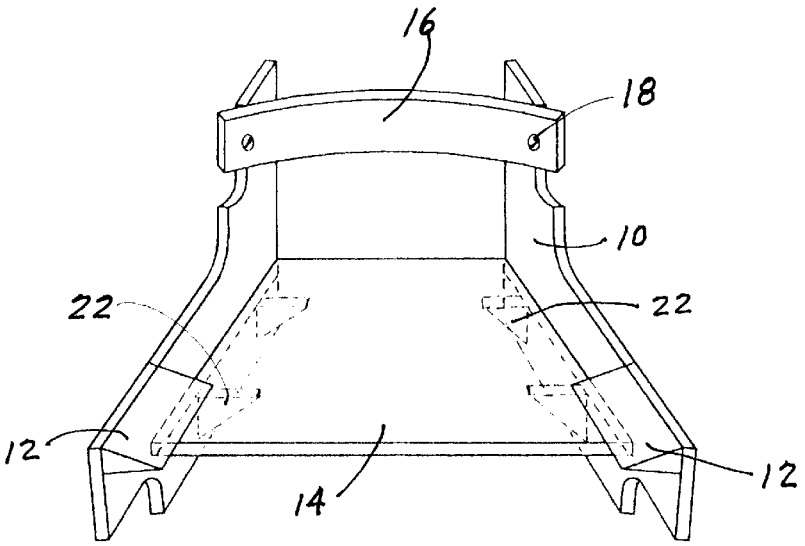
FIG. 2 is a perspective showing seat, knee supports and backrest.
Figure 1:
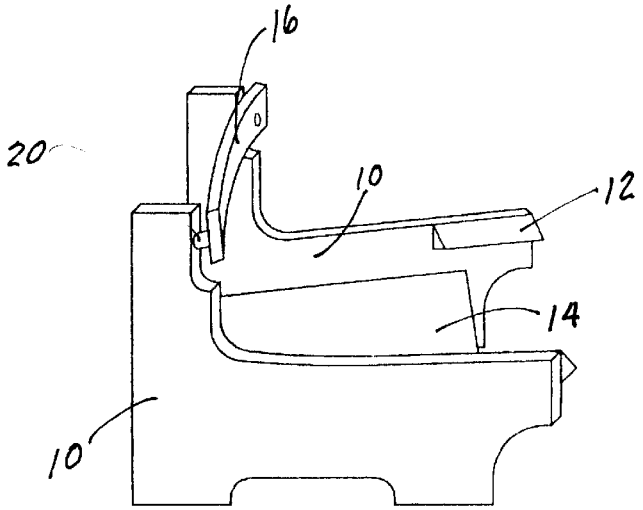
FIG. 1 is a side view perspective of the HI-CHI meditation chair showing knee supports and a pivotal backrest.
Figure 3:
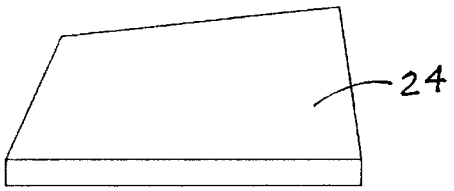
FIG. 3 shows a cushion cut to fit the chair depicted in FIGS. 1 & 2.
Figure 4:
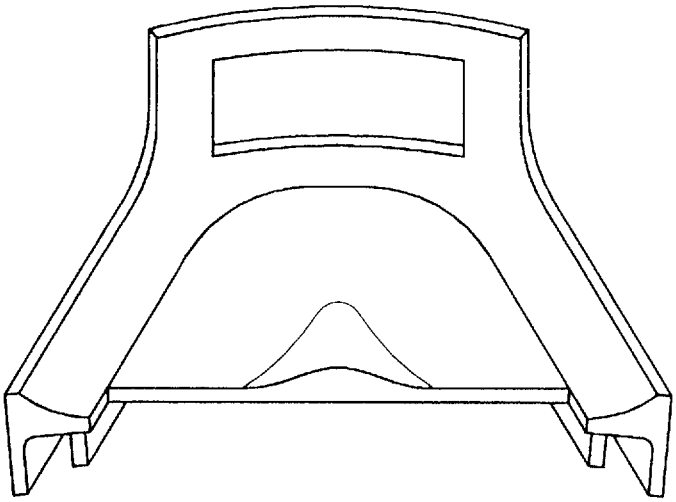
FIG. 4 shows a ramification of FIG. 1 and FIG. 2, it is a molded chair with knee supports, contoured seat and a stationary backrest.

A typical embodiment of the HI-CHI meditation chair is illustrated in FIG. 1 (side view) and FIG. 2 (front view) with a ramification as shown in FIG. 4. The chair has two sides 10 being symmetrical in dimension. Each side has a knee support 12 attached to the front inside edge. The seat 14 is trapezoidal in shape and attached to each side with supporting glue blocks 22 on the underside to give added strength to the seat. The backrest 16 is of a curved design and attached to the top of each side 10 with a screw 18 and a flexible spacer 20 between the backrest 16 and the top of the side 10 to allow a pivoting action to accommodate the user with the most comfort. A covered foam cushion 24 is shown in FIG. 3 which has been cut to fit the trapezoidal seat 14. FIG. 4 shows a ramification of FIGS. 1 & 2 being a molded embodiment with a contoured seat and stationary backrest. The chair can be made of rigid sheet material such as high quality plywood, or molded of a strong plastic resin extrusion or of a composite material.

OPERATIONS—FIGS. 1,2,4

The manner in which the HI-CHI meditation chair is used is for the user to sit with the small of his or her back resting against the backrest and the legs crossed and drawn in closely with the knees or the knee area resting on the knee supports. This posture gives the ultimate support for full relaxation and meditation while maintaining an upright lotus style position.

SUMMARY, RAMIFICATIONS AND SCOPE

Thus, the reader of this invention will see and understand the value of a specially designed meditation chair that enables persons of all ages to attain the lotus style position, which is the preferred position for meditating, while giving full support for maximum relaxation. The ramification shown in FIG. 4, a molded version, could be a possible means to produce a more affordable chair.

Other variations are possible, such as adjustable or removable knee supports, or padded back and knee supports.

I claim:

1. A chair for positioning an occupant near the floor in a lotus style position for purposes of meditation comprising:

two opposing unitary sides comprising rigid sheet material, each side having a seat portion, a front leg and a rear leg extending downwardly from said seat portion, and a top portion extending upwardly from said seat portion at a rear end thereof;

a generally trapezoidal shaped seat rigidly interconnecting said two opposing sides at said seat portion, a wide end of said trapezoidal shaped seat toward a front of said chair to accommodate the spread knees of said occupant in said lotus style position;

two knee supports each attached to an inside of a respective one of said opposing sides above said seat, said knee supports each having a major portion extending forward of said seat and defining a surface which extends inwardly and downwardly to receive and give fall support to said occupant's knees when sitting in said lotus style position.

2. A chair according to claim 1, further comprising a back support pivotally connected by a screw passing through each of two ends of said back support and into a respective one of said top portions of said opposing sides with a flexible spacer between said back support and each top portion.

3. A chair in accordance with claim 1, further comprising a foam cushion cut to fit said trapezoidal shaped seat.

4. A chair in accordance with claim 1, further comprising a plurality of supporting blocks affixed at intersections of said seat and said sides of said chair.

* * * * *